United States Patent [19]

McNew

[11] Patent Number: 5,029,743

[45] Date of Patent: Jul. 9, 1991

[54] DOCUMENT FEED TRAY FOR FEEDING ELONGATED FAN-FOLDED PAPERS THROUGH A REPRODUCING APPARATUS

[75] Inventor: Thomas A. McNew, Oklahoma, Okla.

[73] Assignee: Digital Magnetic Systems, Inc., Oklahoma City, Okla.

[21] Appl. No.: 417,486

[22] Filed: Oct. 5, 1989

[51] Int. Cl.[5] ..... B65H 17/42

[52] U.S. Cl. ..... 226/199; 226/109; 355/72

[58] Field of Search ..... 226/196, 199, 109, 110; 355/202, 316, 72, 73, 75; 271/162, 164, 145; 211/45, 50, DIG. 1, 126, 88; 220/18; 242/129.5, 76

[56] References Cited

U.S. PATENT DOCUMENTS

| | | | |
|---|---|---|---|
| 2,702,649 | 2/1955 | Neilson | 220/18 |
| 4,185,760 | 1/1980 | McNew | 226/109 |
| 4,310,126 | 1/1982 | Norleen | 242/85 X |
| 4,365,733 | 12/1982 | McNew | 226/109 |
| 4,423,720 | 9/1983 | Grant | 226/196 X |
| 4,492,355 | 1/1985 | Bylin | 211/DIG. 1 X |

FOREIGN PATENT DOCUMENTS

| | | | |
|---|---|---|---|
| 3330868 | 3/1984 | Fed. Rep. of Germany | 271/162 |

*Primary Examiner*—Daniel P. Stodola
*Assistant Examiner*—Paul Thomas Bowen
*Attorney, Agent, or Firm*—Laney, Dougherty, Hessin & Beavers

[57] ABSTRACT

A system for passing long fan-folded documents and corresponding copy paper through a reproducing apparatus and including a collapsible, upright stand which carries a pair of copy paper roll supporting elements, a pair of paper guide plates pivotally and detachably connected to the top of the stand, and a guide bar for guiding copy paper from a roll on the stand to the guide plates. The system further includes an improved, two-part feed tray detachably mounted on the reproducing apparatus. Each part is selectively positionable on the reproducing apparatus to facilitate containment of a fan-folded document to be reproduced. Each feed tray part includes a base plate having a downwardly extending strap to locate the tray on the reproducing machine, and at least one upwardly projecting stop rib spaced from a paper discharge slot at the front side of each tray part, and acting as an indexing abutment for contacting and positioning the fan-folded document in the tray.

13 Claims, 3 Drawing Sheets

DOCUMENT FEED TRAY FOR FEEDING ELONGATED FAN-FOLDED PAPERS THROUGH A REPRODUCING APPARATUS

FIELD OF THE INVENTION

This invention relates to ancillary or accessory equipment used in conjunction with document copying or reproducing machines for feeding elongated original documents to such machines for the purpose of permitting them to be copied or reproduced. More specifically, but not by way of limitation, the invention relates to apparatus for feeding elongated fan-folded original documents to a xerographic reproducing machine.

BACKGROUND OF THE INVENTION

1. Brief Description of the Prior Art

In my U.S. Pat. No. 4,185,760, and my U.S. Pat. No. 4,365,733 entitled "SYSTEM FOR PASSING ELONGATED PAPER THROUGH A REPRODUCING APAPRATUS", I describe a system by means of which elongated, relatively narrow sheets of copy paper can be fed through a xerographic copying machine in synchronization with the feeding to the machine of elongated fan-fold type original documents. The system described in my two earlier patents satisfy the need for enabling the conventional xerographic copying apparatus to be utilized for producing continuous copies of such elongated original documents as galley proofs of manuscripts, oil and gas well logs, electrocardiograms, teletype printouts, strip charts made on various types of continuous recorders, adding machine tapes, computer printouts, the output of graphic plotters of seismic data, and the like.

That part of the system described in my U.S. Pat. No. 4,365,733 for feeding elongated fan folded original documents has worked well in practice, but it is limited in its capability for feeding variously sized fan-folded documents to the copying apparatus. Thus, where a fan-folded document of different width is to be copied, adjustments have to be made which require some skill, or an additional and different document feeding tray, having a different transverse dimension, must be placed within the system in order to accommodate the differently dimensioned document to be fed. Moreover, the stability of the original document feed tray in its position on the copy machine is such that it can be inadvertently bumped or displaced so that it will not feed truly without re-setting or re-adjustment.

Although the document feed trays utilized in the systems which I have previously patented are generally satisfactory where only one or two widths of fan-folded original documents are to be copied, they exhibit several less than optimum characteristics. I have now invented an improved feed tray which allows the feeding of various sizes of fan-folded documents to a reproducing apparatus in a more convenient and trouble-free fashion, and without the requirement to change out the feed trays as the original document size varies.

BRIEF DESCRIPTION OF THE PRESENT INVENTION

Broadly described, the present invention is an improvement in the system for passing elongated paper through a copy machine in order to copy indicia and data from an elongated original document on an elongated copy paper, as both are continuously passed through the copy machine. The system includes a copy roll supporting subassembly which functions to support a plurality of rolls of elongated copy paper and position this paper for optimum feeding to a reproducing or copying machine.

A second important subassembly which has been improved in the system of the present invention, and is hereinafter described, is the feed tray, which is actually a two-part structure especially constructed to facilitate rapid mounting on the copying machine, containment of one or a plurality of variously sized, fan-folded elongated original documents supported in fan-folded stacks within the tray, and for feeding these fan-folded documents from the feed tray into the copying machine.

The third subassembly in the system is a document collection tray detachably connected to the copying machine and positioned at a location to intercept the fan-folded original document after it has been passed through the copying machine.

The improved paper feed tray of the present invention consists of a pair of individually movable, cooperating tray halves. These feed tray halves support and guide the fan-folded original document which is to be copied. Each tray half has a base plate which carries a downwardly extending abutment on the lower side thereof for positioning or indexing the tray half with respect to the reproducing machine in a consistent and predetermined manner. The tray halves are attached to the copying machine by magnets or other fastening means which will permit simple, speedy detachment from the machine when the feed tray is not to be used.

On each feed tray half, an edge guiding plate projects upwardly at a right angle from the center of the base plate. The sides of the stacked, fan-folded original document are guided by the edge guiding plates in the two tray halves In their operative position, these tray halves are oriented so that the edge guiding plates extend substantially parallel to each other at a selected horizontal spacing. A paper stop element for indexing or arresting movement of the forward edge of the fan-folded original document stack projects from the upper surface of the base plate of each of the tray halves, and each paper stop element lies substantially perpendicular to the edge guiding plate of the respective tray half upon which it is located. A guide slot means projects outwardly from the opposite sides of the guiding plate, and in a preferred embodiment, is an elongated rod which is spaced upwardly from the base plate. This guide slot rod functions to guide the paper being fed out of the fan-folded stack to the copy machine.

An object of the present invention is to provide a document feed tray which can be rapidly adjusted in its position on the copying machine to accommodate an almost infinite number of fan-folded original document sizes, and yet is capable of accurately and truly guiding each such fan-folded elongated document to and through the reproducing machine as the feed tray is utilized.

Another object of the present invention is to provide a two-part document feed tray useful for feeding elongated fan-folded original documents to a copying machine for the purpose of copying indicia therefrom, with each of the two parts of the document feed tray being quickly and selectively attachable to the upper side of the copying machine. The copy machine cooperates in a selected manner with each of the two feed tray halves to accommodate variously sized original documents as they are fed through the machine.

Another object of the invention is to provide a document feed tray for feeding documents to be copied through a reproducing machine, with the feed tray being quickly mountable on the machine without the use of any types of fastening devices which mechanically interengage or interlock with any part of the copy machine, thus facilitating the rapid removal of the feed tray when it is not in use.

A further object of the invention is to provide a relatively economical, easily installed and used system by which elongated, indicia-carrying documents can be fed through a xerographic copying machine at the same time that elongated copy paper is being fed through the machine.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

Figure 13:
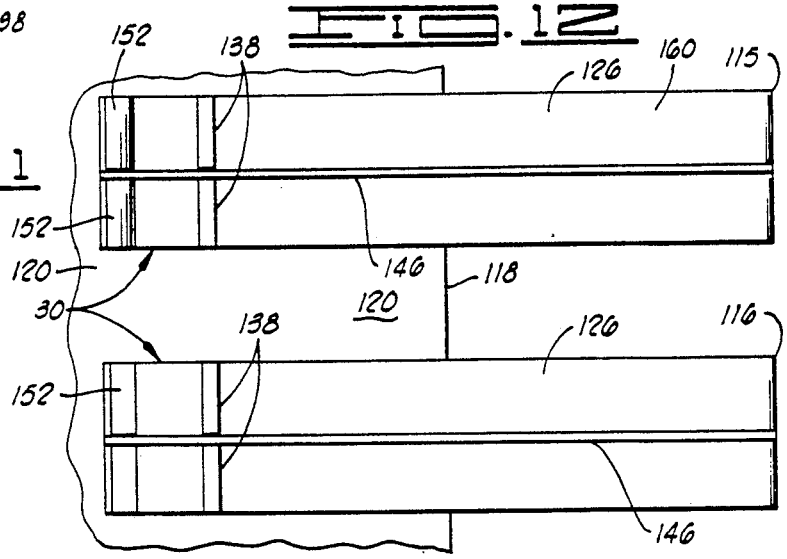
FIG. 13 is a plan view of the two identical parts of the document feed tray of the present invention as they are used in cooperation with each other, and illustrating a preferred embodiment of the invention as it is positioned on the upper side of a typical xerographic reproducing machine.
Figure 18:
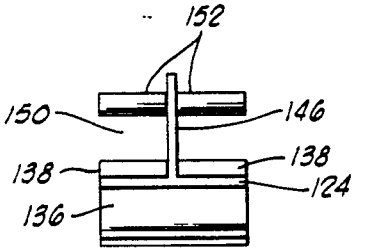
Figure 14:
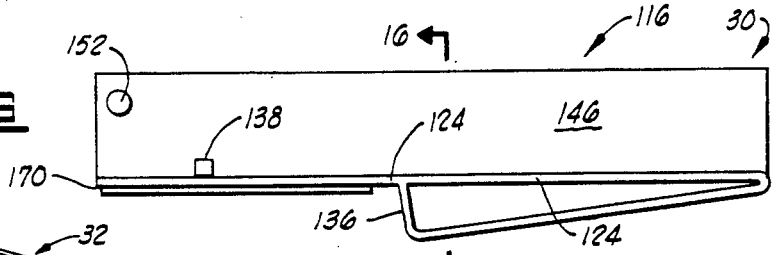
FIG. 14 is a side elevation view of one of the halves of the preferred embodiment of the document feed tray of the invention illustrated in plan view FIG. 13.
Figure 15:
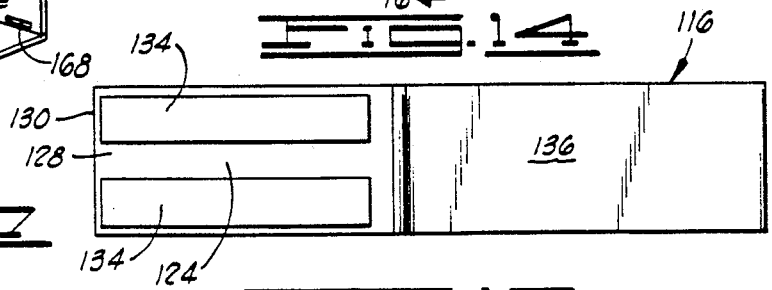

FIG. 15 is a bottom view of the improved document feed tray of the invention showing the magnetic attachment used, and the abutment step, which together function to locate and retain each one of the halves of the document feed tray in position on the upper side of a reproducing machine. FIG. 16 is an end elevation view of one of the halves of the document feed tray depicted as a preferred embodiment thereof in FIGS. 13–15, and showing this part of the document feed tray as it appears when viewed from ahead of the document feed tray in the downstream sense of the direction of paper feed therefrom.

Figure 17:
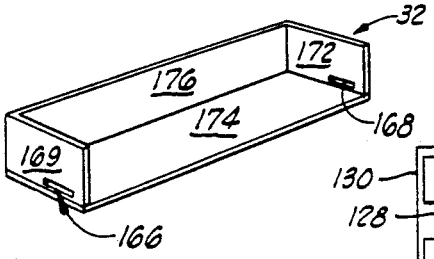

FIG. 17 is a perspective view of the collection tray which is detachably connectable to the copying machine for the purpose of catching and deflecting into a fan-folded stack, fan-folded original documents after they have passed through the copying machine.

DETAILED DESCRIPTION OF A PREFERRED EMBODIMENT OF THE INVENTION

Figure 1:
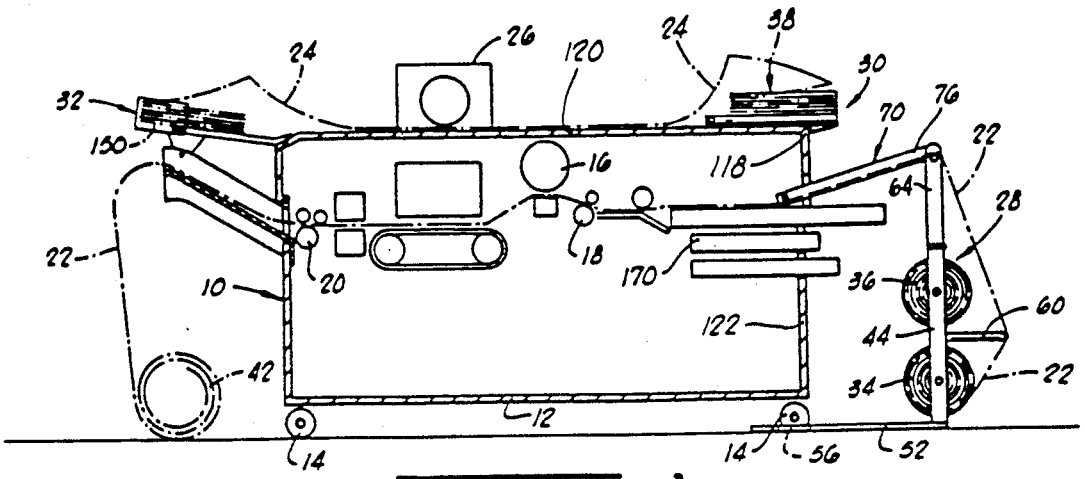
FIG. 1 is a view, partially in side elevation and partially in section, illustrating a preferred embodiment of the system of the invention as it is positioned in relation to, and used in combination with, a xerographic copying machine.

Referring initially to FIG. 1 of the drawings, shown therein is a copying or reproducing machine designated generally by reference numeral 10. The illustrated copying machine is of the xerographic type, and includes a housing 12 mounted upon suitable casters or rollers 14. On the interior of the housing, the copying machine includes a xerographic drum 16, copy paper feed rollers 18 and copy paper discharge rollers 20. The feed rollers 18 and discharge rollers 20 and the equipment associated therewth are conventional in such machines, and are used to pass a copy paper beneath the xerographic drum for purposes of transferring indicia thereto from an original document passed through the copying machine in a manner hereinafter described.

In the drawings under discussion, an elongated, relatively narrow sheet of copy paper is illustrated in dashed lines and is designated by reference numeral 22. An original document to be copied using the copying machine 10 is designated by reference numeral 24. It is shown being passed through a feed mechanism 26.

The system for passing elongated papers through the copying machine 10 includes a copy roll supporting subassembly, designated generally by reference numeral 28, an original document dual part feed tray, designated generally by reference numeral 30, and a document collection tray, designated generally by reference numeral 32.

As illustrated in FIG. 1, the copy roll supporting subassembly 28 is mounted in an upright position adjacent one side of the copying machine 10 and functions to feed the elongated copy paper 22 from a roll 34 constituting one of a plurality of rolls supported on the roll-supporting subassembly. A second or stand-by roll 36 is illustrated as it is concurrently supported on the supporting subassembly 28. As further illustrated in FIG. 1, an original document carrying indicia to be transferred to the copy paper 22 and denominated by reference numeral 24 originates from a fan-folded stack 38 placed in a particular location within the document feed tray 30 as hereinafter described. Upon completion of the copying process, the original document is discharged from the copying machine 10 and is automatically stacked in a fan-folded configuration in the document collection tray 32. The copy paper 22 being discharged from the copying machine 10 may be collected in roll form as shown at 42 in FIG. 1, or, in the alternative, may be stacked in a fan-fold configuration in the document collection tray 32 if it originates from a roll of pre-fan-folded paper of the type described in my copending U.S. Pat. No. 4,270,911.

The copy roll supporting subassembly 28 includes a collapsible upright stand made up of a pair of spaced, substantially parallel vertically extending, lower side frame members 44 and 46 which are interconnected at their opposed upper ends by a horizontally extending transverse top frame member 48. At their lower ends, the side frame members 44 and 46 of the upright stand are interconnected by a horizontally extending transverse lower frame member 50. The lower frame member 50 is secured at its outer ends, where it is joined to the side frame members 44 and 46, to a pair of horizontally extending, parallel floor plates 52 and 54. The floor plates 52 and 54 have large slots 56 and 58, respectively, formed therein adjacent the forward ends thereof for the purpose of allowing the rollers 14 at two opposed corners of the copying machine 10 to be placed in these slots, thereby immobilizing and stabilizing the copy roll supporting subassembly 28. At the midportions of the lower side frame members 44 and 46 of the upright stand, a U-shaped copy paper guide bar 60 has its legs secured to the inner side faces of the lower side frame members 44 and 46 and extends substantially horizontally so that its web portion 60*a* is positioned outwardly from the lower side frame members to guide the copy paper 22 from the roll 34 out and around the upper roll 36 of copy paper and to a position at the upper side of the upright stand for a purpose hereinafter described.

The upright stand further includes a pivotable upper section formed by a horizontal, transversely extending lower frame plate 62 which is hingedly connected, and extends parallel, to the top frame member 48, and a pair of parallel, vertically extending upper side frame members 64 and 66 which are disposed in coplanar alignment with the lower side frame members 44 and 46. The upper section of the upright stand further includes a horizontally extending, transverse support rod 68 which extends between, and is supported by, the side frame members 64 and 66.

Figure 2:
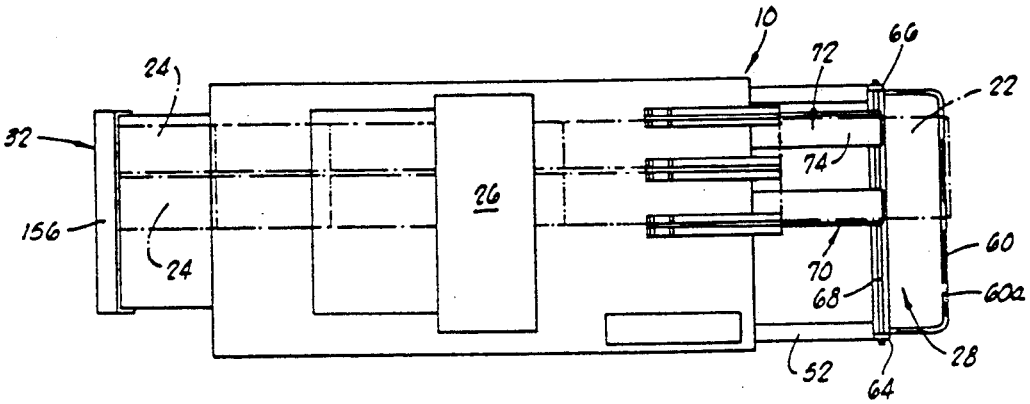
FIG. 2 is a plan view of the system and copying machine depicted in FIG. 1. Paper being passed through the copying machine is illustrated in dashed lines.
Figure 3:
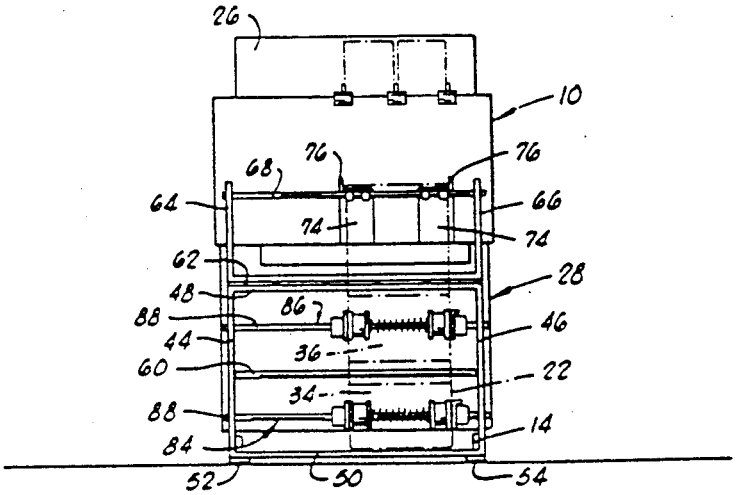
FIG. 3 is an end elevation view of the system of the present invention positioned adjacent a copying machine and illustrating, in dashed lines, copy paper and fan-folded original documents as they are being fed to the copying machine.
Figure 4:
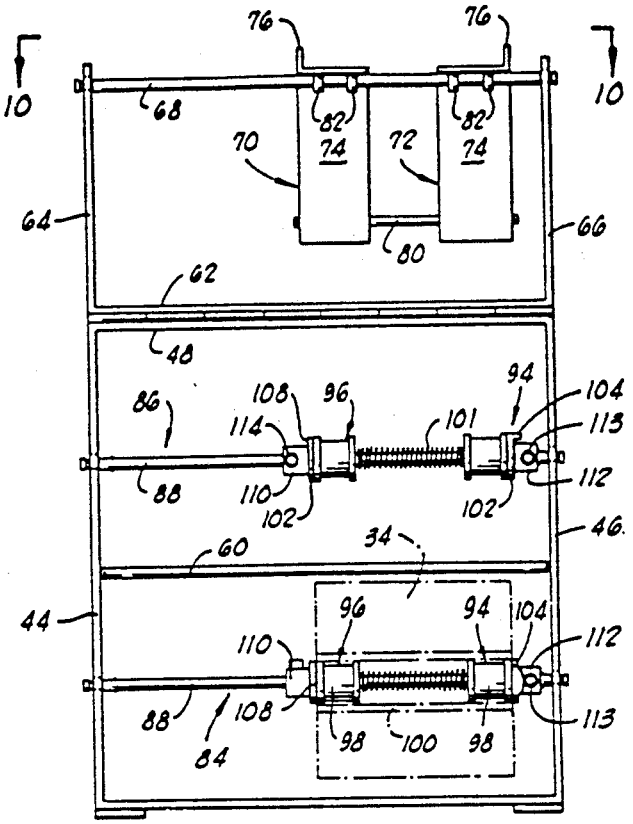
FIG. 4 is a side elevation view of a copy roll supporting subassembly and illustrating in dashed lines a copy roll as it is supported in this subassembly.
Figure 5:
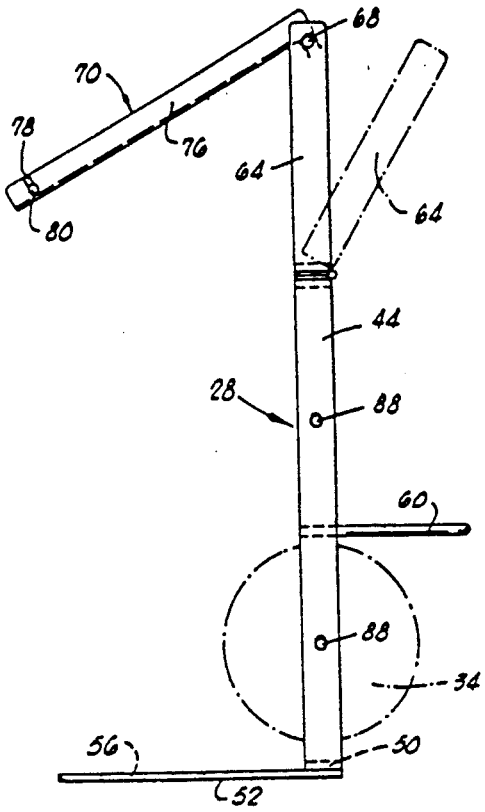
FIG. 5 is a side elevation view of the copy roll supporting subassembly illustrated in FIG. 4, and showing in dashed lines a roll of copy paper supported on the subassembly, and further showing in dashed lines an alternative position of a part of the subassembly as it is being folded to a compact storage position.
Figure 10:
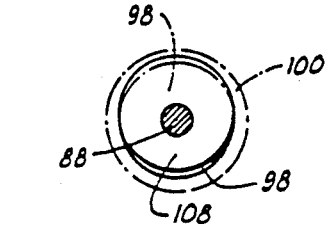
FIG. 10 is a sectional view taken along line 10—10 of FIG. 6.
Figure 11:
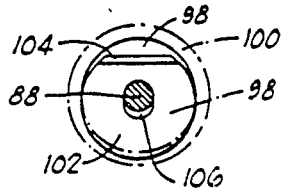
FIG. 11 is a sectional view taken along line 11—11 of FIG. 6.
Figure 12:
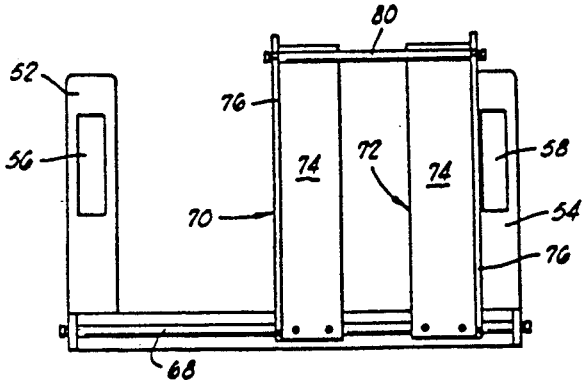
FIG. 12 is a plan view of the copy roll supporting subassembly forming a part of the system of the invention.

A pair of paper guide elements denominated generally by reference numerals 70 and 72 are detachably and pivotally connected to the support rod 68, and are adjustably and selectively spaced horizontally from each other. The paper guide elements 70 and 72 are detachably and pivotally connected to the support rod 68, and are adjustably and selectively spaced horizontally from each other. The paper guide elements 70 and 72 each include a paper support plate 74 and a vertically extending guide flange 76 which projects normal to the respective support plate at a side edge thereof (see FIGS. 2 and 10). Each of the guide flanges 76 on the two paper guide elements 70 and 72 is provided with a downwardly extending slot 78 formed therein near the end of the respective guide flange which is opposite the end of the respective paper guide element detachably connected to the rod 68. A hold-down rod 80 is laid in the slots 78 and rests upon copy paper being passed through the guide elements 70 and 72 in a manner hereinafter described. Each of the guide elements 70 and 72 is attached to the rod 68 by means of a pair of spring clips 82 secured to the underside of the respective plates 74 and frictionally gripping the rod 68 by spring tension. It will be noted from the described construction of the paper guide elements 70 and 72 that they can be moved toward or away from each other along their respective points of engagement with the rod 68 so that different widths of copy paper can be accommodated between the guide flanges 76 thereof as may be required.

Figure 6:
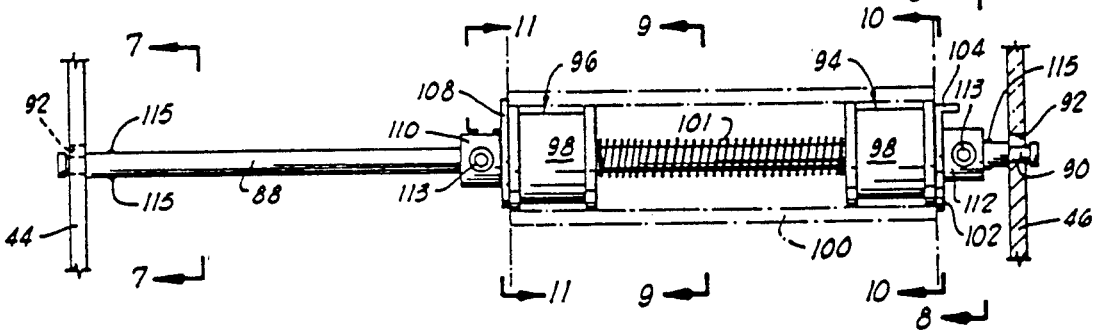
FIG. 6 is a detail view illustrating in elevation one of the two copy roll supporting elements employed as a part of the copy roll supporting subassembly. A portion of the copy roll supportable thereon is illustrated in dashed lines.
Figure 7:
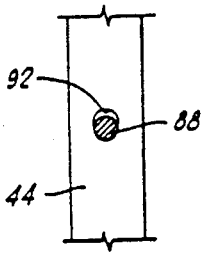
FIG. 7 is a sectional view taken along line 7—7 of FIG. 6.
Figure 8:
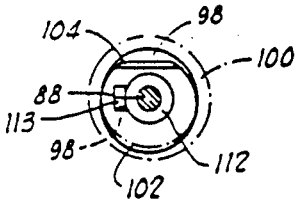
FIG. 8 is a sectional view taken along line 8—8 of FIG. 6.
Figure 9:
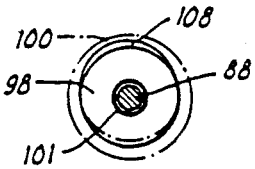
FIG. 9 is a sectional view taken along line 9—9 of FIG. 6.

Also included in the roll supporting subassembly 28 are a pair of roll supporting elements designated generally by reference numerals 84 and 86. The roll supporting elements 84 and 86 are identical, and each includes an elongated cylindrical bar 88 having a pair of circumferentially extending grooves 90 in the opposite end portion thereof (see FIG. 6). The grooves 90 permit the respective bars 88 of the roll supporting elements 84 and 86 to be received in openings 92 formed in the opposed parallel lower side plates 44 and 46. The bars 88 are thus able to rotate about their longitudinal axes as a consequence of the bearing surface formed between the grooves 90 and the lower side of the respective circular openings 92 into which the ends of the bars 88 are placed.

Slidably mounted on each of the bars 88 within the respective roll supporting elements 84 and 86 are a pair of roll supporting hub elements designated generally by reference numerals 94 and 96. Each of the roll supporting hub elements 94 and 96 includes a generally cylindrical core insert block 98. Each core insert block 98 is dimensioned to permit the outer periphery thereof to frictionally engage the inner surface of a cardboard core 100 conventionally located at the center of a copy paper roll, and functioning as a support for the concentric convolutions of copy paper wound thereupon. Each of the core insert blocks 98 is slidably mounted on the respective bar 88 for axial movement therealong. A helical spring 101 extends around the bar 88 between the core insert blocks 98.

Flatly abutting the relatively large end or base of one of the core insert blocks 98 forming a part of the roll supporting hub element 94 is a roll stop plate 102. The roll stop plate 102 has a circular outer periphery, and a finger flange 104 which projects normal to the major plane of the stop plate and in a direction away from the core insert block 98. The roll stop plate 102 is provided at its center with an elliptical slot 106. The diameter of the roll stop plate 102 is slightly smaller than the inside diameter of the cardboard core 100, and this roll stop plate is used for a purpose and in a manner hereinafter described.

Bearing flatly against the core insert block 98 of the roll supporting hub element 96 of each of the roll supporting elements 84 and 86 is a second roll stop plate 108. The second roll stop plate 108 is disc-shaped with a circular outer periphery, and differs from the roll stop plate 102 in that it does not include a finger flange 104 and has a small circular opening radially offset from the center thereof which is sized to closely accommodate the elongated cylindrical bar 88 passed therethrough. The diameter of the roll stop plate 108 is slightly larger than the diameter of the cardboard core 100, and one side edge thereof projects past the periphery of the core 100 due to the offset of the circular opening which receives the bar 88.

Slidably mounted on each of the elongated cylindrical bars 88 forming a part of each of the roll supporting elements 84 and 86 are a pair of adjustable stop elements 110 and 112. Each of the adjustable stop elements 110 and 112 is in the form of a cylindrical block having a central bore to slidingly accommodate the respective elongated cylindrical bar 88. Each stop element 110 and 112 further has a threaded radial opening drilled therethrough to accommodate a set screw 114 which is used to fix the position of the respective stop element at a selected location along the elongated cylindrical bar 88.

In the use of each of the roll supporting elements 84 and 86, a roll of copy paper constituted by concentric convolutions of elongated copy paper wound upon a centrally disposed hollow cardboard core 100 of cylindrical configuration is mounted on each of the roll supporting elements. To place the copy paper rolls 34 and 36 in operative position on the respective roll supporting elements 84 and 86, the respective elongated cylindrical bar 88 is first removed from its supported position in the openings 92 provided in the lower side frame elements 44 and 46 so that opposite ends of the bar 88 are exposed. The roll stop plate 102 can then be manipulated by means of the finger flange 104 so that it is precisely centered on the bar 88. In this centered position, it is in contact with the end face of the core insert block 98, and the stop element 112 also bears against it to hold it in the centered position.

It will be recalled that the roll stop plate 102 is slightly smaller in diameter than the inside diameter of the cardboard core 100 of the copy paper roll. Thus, when the roll stop plate 102 is centered on the bar 88, the copy paper roll can be passed over the roll stop plate 102 and the core insert block 98 and brought to bear against the second roll stop plate 108. At this time, the outer peripheries of the core insert blocks 98 bear against the inside surface of the hollow cylindrical cardboard core 100, and one end of this core is abutted against the second roll stop plate 108 which forms a part of the roll supporting hub element 96.

When the core is so positioned, the ellipitcal slot 106 at the center of the roll stop plate 102 permits this roll stop plate to be moved radially outwardly to a position at which its circular outer periphery is eccentric with respect to the longitudinal axis of the bar 88. The roll stop plate 102, after being moved to this position by the use of the finger flange 104, is now in a blocking position to block movement of the hollow cylindrical cardboard core 100 to the right as this element is viewed in FIG. 6. The cardboard core 100 is now precisely centered between the first roll stop plate 102 and the second roll stop plate 108 and cannot pass by these elements. The roll of copy paper is thus retained against axial movement along the bar 88, and is also supported upon the outer peripheries of the core blocks 98 of the respective roll supporting hub elements 94 and 96.

In order to prevent inadvertent loss of the stop elements 110 and 112, of the roll stop plates 102 and 108 and of the core insert blocks 98 of each of the roll supporting elements 84 and 86, each of the elongated bars 88 includes a pair of radial protuberances 115 adjacent each of its ends (inside the circumferential grooves 90) so that the respective stop elements 110 and 112 cannot pass the ends of the respective bars 88 and be removed.

When the copy roll supporting subassembly 28 is in its full usage mode, it carries and supports an active copy paper roll and a stand-by or extra copy paper roll. When the copy paper roll 34 is used to feed copy paper to the copying machine 10, the copy paper 22 is extended over the guide bar 60 and up to the top side of the upright stand of the copy roll supporting subassembly. From this point, the copy paper 22 is led between the paper guide elements 70 and 72 with its opposite edges being limited against lateral shifting by the guide flanges 76 carried by each of the paper guide elements 70 and 72. The copy paper 22 is supported as it moves between the paper guide elements 70 and 72 by the paper support plates 74 forming a part of each of these elements. Further, it is retained against buckling by the hold-down rod 80 at the outer ends of each of the paper guide elements 70 and 72. After passing beneath the hold-down rod 80, the copy paper 22 is drawn into the copying machine by the feed rollers 18 preparatory to passing the copy paper under the xerographic drum 16 in a conventional manner.

If desired, copy paper 22 can be drawn from the roll 36 instead of from the copy paper roll 34. In this event, the copy paper 22 is fed directly from the outer periphery of the copy paper roll 36 into the channel formed between the paper guide elements 70 and 72, under the hold-down rod 80 and into the copying machine 10. Either copy paper roll may be used at any time.

Before terminating discussion of the copy roll supporting subassembly 28, it is pointed out that the subassembly can be folded down into a compact form by folding the upper side frame members 64 and 66 downwardly about the hinge which interconnects the lower frame plate 62 to the top frame member 48 until the upper side frame members 64 and 66 rest against, and extend parallel to, the lower side frame members 44 and 46. It will also be noted that the two paper guide elements 72 and 74 can be detached from the support rod 68 by simply lifting them up to disengage the spring clips 82 from the support rod. Last, each of the roll supporting elements 84 and 86 can be removed from the upright stand by simply lifting the respective elongted cylindrical bars 88 in each of these roll supporting elements upwardly slightly so that its opposite ends can be disengaged from the openings 92 formed in the lower side frame members 44 and 46. The entire copy roll supporting subassembly can thus be dismantled and folded into a collapsed position so that it can be easily transported or stored.

The ability to fold down the upper side frame members 64 and 66 also facilitates ease of access to the stored paper trays 170 which are stored in the copying machine at the location shown in FIG. 1.

The improved document feed tray 30 of the present invention is used for containing and feeding one or more fan-folded original documents from which indicia are to be transferred to, and reproduced on, the copy paper 22. The feed tray 30 includes a pair of independently movable and interchangeable paper support and guiding tray halves 115 and 116. The feed tray halves 115 and 116 are supported on the copy machine at the upper side thereof at the intersection 118 of a horizontally extending top wall 120 and a vertically extending side wall 122 of the copy machine as shown in FIG. 1.

Each of the tray halves 115 and 116, has a base plate 124 having an upper surface 126, a lower surface 128 and a forward edge 130. A portion of the lower surface 128 of the base plate 124 rests upon a horizontally extending top wall 120 of the copying machine 10, and is held thereon by an attachment means, which, in the preferred embodiment, are magnets 134 which magnetically adhere the respective tray half to the upper side of the copying machine.

Each of the tray halves 115 and 116 is maintained in a feeding position on the copying machine by abutment means 136 which projects from the lower surface 128 of the base plate 124. The abutment means 136, in the preferred embodiment, comprises a step secured to the lower surface 128 of the base plate 124 at a location spaced from the forward edge 130 of the base plate. In a preferred embodiment, this step is formed by bending a right angle into an elongated strap intermediate its length so that the step is formed at the angle where the tray step abuts the side wall 122 at the line of intersection 118 with the top wall 120. Where the tray half is constructed of a synthetic resin, the strap can be molded with the right angle bend or step formed therein. The step abuts the side wall 122 at its line of intersection 118 with the top wall 120.

A pair of transverse paper stop elements or ribs 138 project from the upper surface 140 of the base plate 124. Each stop element 138 extends substantially normal to the side edges of the base plate 124 and parallel to the forward edge 130 of each of the tray halves. The transverse paper stop elements 138 provide a means for retaining a stack of fan-folded paper 38 in the desired feed position on the upper side of the base plate 124. An edge guiding plate 146 extends upwardly at a right angle to the center line of the base plate 124 of each of the feed tray halves of 115 and 116. The edges of the fan-folded document 38 being copied are retained in proper feeding position as the document moves out of the feed tray halves by the unfolding of the fan-folds. As the fan-folded documents are fed from the stack 38, the leading portion of the document passes through a slot 150 defined between a rod 152 and the base plate 124. The rods 152 extend in a cantilevered fashion from the opposite sides of each of the edge guiding plates 146 perpendicular to the principal plane of the respective edge guiding plate, and substantially parallel to the base plate 124.

Each of the tray halves 115 and 116 is longitudinally bisected by the respective edge guiding plate 146. Thus, in a preferred embodiment of the invention, each of the tray halves 115 and 116 is identical to the other tray half, and the tray halves are completely interchangeable since they incorporate identical structure on each side of the edge guiding plate 178 in the preferred embodiment of the invention.

It will be perceived that the two feed tray halves 115 and 116 can be quickly positioned in a proper feed status and orientation on the upper side of the copying machine adjacent the intersection of the side wall and the top wall of the copying machine. Moreover, by selectively spacing the tray halves 114 and 116 from each other, any width of fan-folded paper which is to be fed from the stack into the copying machine can be easily and efficiently accommodated.

After passing through the slot 150, the original documents are passed through the imaging housing 26 and are discharged therefrom on the opposite side of the copying machine 10. the discharging original documents 24 pass over one end of the copying machine and enter a document collection tray 32. The document collection tray 32 is detachably mounted on the copying machine 10 by lug-receiving slots 166 and 168 formed in opposed side walls 169 and 172, respectively, of the collection tray. The collection tray 32 also includes a bottom plate 174 against which the leading edge of the discharging original documents can slide, and a deflection end plate 176. The documents impinging upon the deflection end plate 174 are deflected into a fan-fold configuration, and are automatically stacked in such fan-fold configuration, as illustrated in FIG. 1.

The system described permits at least two original fan-folded documents to be fed simultaneously and in synchronism from feed trays 30 through the imaging housing 26 of the copying machine 10 and to be ultimately concurrently automatically fan-folded into stacks by the deflecting action of the document collection tray 32. Concurrently with the feeding of the pair of fan-folded original documents from the feed trays 30, copy paper 22 from one of the copy paper rolls 34 or 36 is fed to the copying machine. The copy paper 22 will usually be of sufficient width that reproduction of the indicia carried on all of the fan-folded original documents being concurrently fed from the feed trays can be placed upon the relatively wide copy paper. Separation of the indicia traces can later be developed by longitudinal severance of the copy paper, if such should be desirable.

From the foregoing description of a preferred embodiment of the invention, it will be appreciated that various changes in the particular structures illustrated in the drawings and constituting preferred arrangements of structure useful in the invention can be effected without departure from the basic principles upon which the invention is bottomed. Changes and innovations of this type are therefore deemed to be circumscribed by the spirit and scope of the invention except as the same may be necessarily limited by the appended claims, or reasonable equivalents thereof.

What is claimed:

1. A document feed tray for feeding elongated fan-folded documents to be copied to a copying machine, which copying machine has a housing which includes a horizontally extending top wall and at least one vertically extending side wall intersecting said top wall at an edge, said feed tray comprising:

a pair of independently movable paper-supporting and edge-guiding tray halves each mountable on the upper side of the top wall of said copying machine housing, each of said tray halves including:

a base plate having a substantially horizontally extending upper surface, and a lower surface, and having a forward edge;

an abutment projecting from the lower surface of said base plate and adapted to register with the edge of said copying machine at the intersection of said side wall and the top wall of said copying machine to thereby position said feed tray half in a feeding position on said copying machine;

attaching means on one of said base plate and said abutment means for attaching said tray half in a selected position on the upper side of said top wall;

an edge-guiding plate projecting upwardly from the upper surface of said base plate and extending normal to said base plate and along a line which intersects said forward edge of said base plate;

a paper stop element projecting from the upper surface of said base plate on at least one of the two opposite sides of said edge-guiding plate at a location spaced from said forward edge of said base plate; and guide slot defining means projecting from at least one side of said guiding plate on the same side thereof as said stop element is located and extending substantially parallel to the upper surface of said base plate at a location spaced upwardly therefrom and disposed between said forward edge and said abutment means, said guide slot defining means defining a guide slot with the base plate through which guide slot at least a portion of a document to be guided is extended.

2. A document feed tray as defined in claim 1 wherein said guide slot defining means comprises an elongated rod cantilevered from said edge guiding plate and defining with said base plate, an elongated slot through which at least a side portion of said elongated document can be extended.

3. The document feed tray as defined in claim 1 wherein said abutment comprises a step secured to the lower surface of said base plate at a location spaced from said forward edge.

4. The document feed tray as defined in claim 3 wherein said step is an elongated strap defining a right angle bend intermediate its length.

5. The document feed tray as defined in claim 1 wherein said attaching means is a magnet secured to the lower surface of said base plate at a location between said forward edge and said step.

6. The document feed tray as defined in claim 1 wherein said paper stop element comprises an elongated rib extending substantially parallel to said forward edge of said base plate.

7. The document feed tray as defined in claim 1 wherein said base plate is substantially rectangular in configuration, including a pair of elongated, parallel side edges extending normal to said forward edge, and wherein said guiding plate is positioned substantially equidistantly from said side edges and extends substantially parallel thereto, and wherein said stop element and guide slot defining means are each provided on each of the opposite sides of said guiding plate.

8. The document feed tray as defined in claim 7 wherein said paper stop element comprises an elongated rib extending substantially parallel to said forward edge of said base plate.

9. The document feed tray as defined in claim 8 wherein said means is a magnet secured to the lower surface of said base plate at a location between said forward edge and said step.

10. A document feed tray for feeding elongated, fan-folded documents to be copied to a copying machine which has a housing which includes a horizontally extending top wall and vertically extending side walls, said feed tray comprising:

a pair of independently movable, paper supporting, edge guiding tray halves each mountable on the upper side of the top wall of said copying machine housing, each of said tray halves including:

a base plate having a substantially horizontally extending upper surface, and a substantially horizontally extending lower surface, and having a forward edge, and a pair of substantially parallel side edges;

means on said base plate, and projecting from the lower side thereof for locating the respective tray half at a selected location on the top wall of the copying machine so that said pair of independently movable paper supporting, edge guiding tray halves can be placed in a cooperating relationship to cooperate and support a fan-folded document to be fed to the copying machine;

an edge guiding plate projecting upwardly from the upper surface of said base plate along the longitudinal center line thereof, and extending normal to said base plate and along a line which intersects the forward edge of said base plate and bisects said base plate;

a paper stop element projecting from the upper surface of said base plate on at least one of the two opposite sides of said edge guiding plate at a location spaced from the forward edge of said base plate; and guide slot defining means comprising an elongated rod cantilevered from said edge-guiding plate and defining with said base plate, an elongated slot through which the forward portion of said elongated fan-folded document can be extended in being passed to said copying machine for copying, said elongated rod projecting from the same side of said edge guiding plate as that side upon which said stop element is located, and extending substantially parallel to the upper surface of said base plate at a location spaced upwardly therefrom at a location disposed between said forward edge and said paper stop element in terms of the magnitude of spacing from said forward edge.

11. A document feed tray as defined in claim 10 wherein each of said paper supporting, edge guiding tray halves is molded as a unit of synthetic resin.

12. Apparatus for reproducing data imprinted on elongated fan-folded documents comprising:

a copying machine of generally rectangular parallelepiped configuration and having a top wall and a substantially vertically extending side wall;

a pair of independently movable paper-supporting and edge-guiding tray structures each slidably mounted on the upper side of the top wall of said copy machine housing for sliding movement toward and away from each other for cooperatively supporting a fan-folded document to be copied, and feeding the document to the copying machine, each of said tray halves including:

a flat, substantially monoplanar base plate having a substantially horizontally extending upper surface and a lower surface, and having a forward edge;

a step secured to the lower surface of said base plate at a location spaced from said forward edge and adapted to register with the edge of said copying machine defined by the intersection of said substantially vertically extending side wall and said horizontally extending top wall to position the respective feed tray structure in a selected feeding position on the copying machine;

magnetic attaching means on said base plate for magnetically attaching said tray structure in a selected position on the upper side of said top wall, and in a selected spacing relative to the other of said tray structures;

an edge-guiding plate projecting upwardly from the upper surface of said base plate and extending normal to said base plate and along a line which intersects said forward edge of said base plate, said edge-guiding plate being adapted to cooperate with the edge-guiding plate of the other of said edge-guiding tray structures;

a paper stop element projecting from the upper surface of said base plate on at least one of the two opposite sides of said edge-guiding plate at a location spaced from said forward edge of said base plate; and guide slot defining means projecting from at least one side of said guiding plate on the same side thereof as said stop element is located, and extending substantially parallel to the upper surface of said base plate at a location spaced upwardly therefrom and disposed between said forward edge and said step, said guide slot defining means defining a guide slot with the base plate through which guide slot at least a portion of a document to be guided is extended.

13. Document feed tray structure useful in combination with, and employed cooperatively with, a second of said document feed tray structures for cooperatively holding and feeding an elongated fan folded document to be copied to a copying machine, said document feed tray comprising:

a flat, substantially monoplanar base plate having a substantially horizontally extending upper surface, and a substantially horizontal extending lower surface, and having a forward edge and a pair of spaced, substantially parallel side edges;

abutment means projecting from the lower surface of said base plate forming a stop step positioned on the lower surface of the base plate in a position to register with the edge of a copying machine defined by the intersection of the top side thereof with a side wall thereof;

attaching means on the under side of said base plate between said abutment means and the forward edge of said base plate for attaching said tray half in a selected position on the top of a copying machine;

an edge-guiding plate projecting upwardly from the upper surface of said base plate and extending substantially normal to said base plate and along a line which intersects said forward edge of said base plate, and extending substantially parallel to the side edges of said base plate and located at a position substantially equidistant from the side edges of said base plate;

a paper stop element projecting from the upper surface of said base plate on at least one of the opposite sides of said edge-guiding plate at a location spaced from said forward edge of said base plate; and guide slot defining means projecting from at least one side of said guiding plate at the same side thereof as said stop element is located and extending substantially parallel to the upper surface of said base plate at a location spaced upwardly therefrom, and disposed between said forward edge and said abutment means, said guide slot defining means defining a guide slot with the base plate through which guide slot at least a portion of a document to be guided is extended.

* * * * *